US010433072B2

(12) United States Patent
Yang et al.

(10) Patent No.: US 10,433,072 B2
(45) Date of Patent: Oct. 1, 2019

(54) MICRO-SOUND DETECTION ANALYSIS DEVICE AND ARRAY AUDIO SIGNAL PROCESSING METHOD BASED ON SAME

(71) Applicants: Lin Yang, Heilongjiang (CN); Jianwei Zhang, Heilongjiang (CN); Chengyu Hou, Heilongjiang (CN); Guojian Cao, Heilongjiang (CN)

(72) Inventors: Lin Yang, Heilongjiang (CN); Jianwei Zhang, Heilongjiang (CN); Chengyu Hou, Heilongjiang (CN); Guojian Cao, Heilongjiang (CN)

(73) Assignee: HARBIN INSTITUTE OF TECHNOLOGY, Harbin, Heilongjiang Province (CN)

( * ) Notice: Subject to any disclaimer, the term of this patent is extended or adjusted under 35 U.S.C. 154(b) by 34 days.

(21) Appl. No.: 15/691,628

(22) Filed: Aug. 30, 2017

(65) Prior Publication Data

US 2018/0063648 A1 Mar. 1, 2018

(30) Foreign Application Priority Data

Aug. 31, 2016 (CN) ..... 2016 1 0793786

(51) Int. Cl.
*H04R 31/00* (2006.01)
*H04R 23/00* (2006.01)
(Continued)

(52) U.S. Cl.
CPC ..... *H04R 23/02* (2013.01); *G10L 25/51* (2013.01); *H04R 9/08* (2013.01); *H04R 19/04* (2013.01);
(Continued)

(58) Field of Classification Search
CPC ..... H04R 23/02; H04R 31/003; H04R 7/10; H04R 2307/023; G10L 25/51
(Continued)

(56) References Cited

U.S. PATENT DOCUMENTS

2016/0295338 A1* 10/2016 Lettow ..... H04R 31/003
2017/0006382 A1* 1/2017 Luzzato ..... H04R 7/20
(Continued)

*Primary Examiner* — Vivian C Chin
*Assistant Examiner* — Ubachukwu A Odunukwe
(74) *Attorney, Agent, or Firm* — IPro, PLLC; Qian Gu; Na Xu

(57) ABSTRACT

The equipment of micro-acoustic detection analysis and the processing method of audio signal array based on this equipment, which is the field of micro-acoustic detection, could give a solution that having an excessive sound intensity lower limit using capacitor micro-acoustic detector, and using current way of audio signal processing could not identification and positioning for sound source from micro-acoustic detector at same time. This equipment detects sound pressure based on micro-acoustic detection cell of graphene membrane. The method includes separate the noise from audio signal, compare the extract audio feature and sound source position information with multi sound source signal stored in memory, identifying the target sound source, and the procedure of positioning the sound source according the sound source position information. This invention could be applied to the micro-acoustic detection and then identification and positioning using the detected sound source.

8 Claims, 3 Drawing Sheets

(51) Int. Cl.

| | |
|---|---|
| ***H04R 23/02*** | (2006.01) |
| ***G10L 25/51*** | (2013.01) |
| ***H04R 9/08*** | (2006.01) |
| ***H04R 19/04*** | (2006.01) |
| ***H04R 29/00*** | (2006.01) |

(52) U.S. Cl.
CPC ..... *H04R 23/008* (2013.01); *H04R 29/00* (2013.01); *H04R 2307/023* (2013.01)

(58) Field of Classification Search
USPC ..... 381/92
See application file for complete search history.

(56) References Cited

U.S. PATENT DOCUMENTS

| | | | | |
|---|---|---|---|---|
| 2017/0155993 | A1* | 6/2017 | Boesen ..... | H04R 1/1016 |
| 2018/0066980 | A1* | 3/2018 | Zhou ..... | G01H 11/06 |

* cited by examiner

MICRO-SOUND DETECTION ANALYSIS DEVICE AND ARRAY AUDIO SIGNAL PROCESSING METHOD BASED ON SAME

CROSS REFERENCE TO RELATED APPLICATIONS

This application which claims priority to CN Application No. 201610793786.6, filed on Aug. 31, 2016, the content of which is incorporated herein in its entirety by reference.

FIELD OF TECHNOLOGY

This invention relates to the field of micro-acoustic detection, more specific description is a micro-acoustic detection analysis equipment and an array audio signal processing method based on it.

BACKGROUND OF TECHNOLOGY

Micro-acoustic detection equipment is widely used in the fields of national defense and civil use. Recently, in the micro-acoustic detector application field, the demand that the lower limit of micro-acoustic detection's sound intensity is getting higher and higher. But the lower limit of the exciting capacitive micro-acoustic detector can't meet the demand in its application field.

Additionally, according to the exciting audio signal processing method, the identification and positioning to the detected sound source at same time is impossible.

BRIEF DESCRIPTION OF DRAWINGS

For this invention, a micro-acoustic detection analysis equipment and an array audio signal processing method, will make a detail description in the following context using instances and figures.

In the attached drawings, the same parts use the same signs. The drawings not use actual ratio.

DETAILED DESCRIPTION

Figure 1:
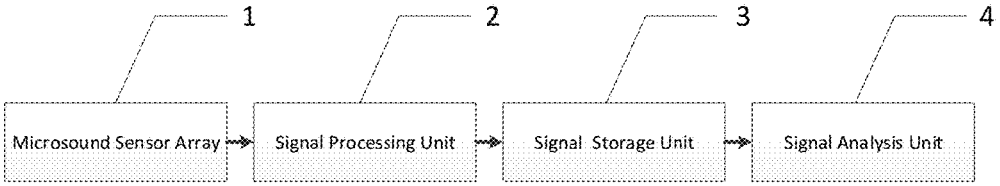
FIG. 1 is an electric structure diagram of the micro-acoustic detection analysis equipment in case 1.

To solve the problem that higher demand in sound intensity detection's lower limit, a micro-acoustic detection analysis equipment is proposed; To solve the problem that micro-acoustic detector could not identification and positioning at same time using current audio signal processing method, a novel method for array audio signal processing is proposed.

The micro-acoustic detection analysis equipment in this invention includes micro-acoustic perception array 1, signal processing unit 2, signal storage unit 3 and signal analysis unit 4;

The micro-acoustic perception array 1 includes multiple micro-acoustic sensors;

The micro-acoustic sensor is used to convert the audio signal into electric signal, then transmit the electric signal to the signal processing unit 2;

The micro-acoustic sensor includes micro-acoustic perception unit, the micro-acoustic perception unit which contains the graphene membrane, and the graphene membrane used to perceive sound pressure;

The signal processing unit 2 is used to process the electric signal, then transmits the electric signal that contain the audio features information and sound source location information to the signal analysis unit 4;

The signal storage unit stores multi sound source objects' audio feature information;

The signal analysis unit 4 is used to compare the electric signal that comes from signal processing unit 2 with multi sound source objects' audio feature information, giving a prompt that found the target sound source when the target has the same feature information in comparison. On the contrary, giving a prompt that no target found when the comparison is done;

The signal analysis unit 4 is also used to position and identify the sound source, that according to the sound source position and characteristic information from electric signal of the signal processing unit 2;

The preference is the micro-acoustic sensor also includes laser 5 and photo-sensitive cells 6;

The micro-acoustic perception unit includes substrate 7, which has a through-hole. The graphene membrane 8 is fixed on one side of substrate 7, covering the through-hole;

When the Laser 5 reaches the surface of the graphene membrane 8 through the through-hole, refraction and reflection are occurred on the surface, then some part of Laser comes to photo surface of the photo-sensitive cells 6;

The photo-sensitive cells 6 is connected with signal processing unit 2;

The micro-acoustic sensor which includes the first permanent magnet 9 and the second permanent magnet 10 also;

The micro-acoustic perception unit includes substrate 7, which has through-hole 11. The graphene membrane 8 is fixed on one side of substrate 7, covering the through-hole 11;

The first permanent magnet 9 and the second permanent magnet 10 are on the substrate 7, and the coupled magnetic field is formed between the first permanent magnet 9 and the second permanent magnet 10;

When shocked by sound pressure, the graphene membrane 8 can cut the magnetic induction line, which generates by the coupled magnetic field, then generate the electric signal;

The electric signal is received by signal processing unit 2.

The preference is the micro-acoustic sensor includes the conductive baffle 12, battery 13 and resistance 14;

The micro-acoustic perception unit includes substrate 7, which have through-hole 11. The graphene membrane 8 and the conductive baffle 12 are fixed on each side of substrate 7, forming a parallel plate capacitor;

The parallel plate capacitor is to cascade the battery 13, resistance 14 and signal processing unit 2, forming an electric circuit.

The preference is that there is clearance between the graphene membrane 8 and the through-hole.

The optional is the micro-acoustic perception unit's distribution shows as line, plane, arc or cambered surface.

The optional is the graphene membrane (8) can be replaced with graphene oxide membrane.

The array audio signal processing method of the micro-acoustic detection analysis equipment, characterized by the following procedures must be done before the signal processing method as described.

$1^{st}$, select a micro-acoustic perception unit distribution mode according the location of the sound source, and make channels that transmit the audio signal of micro-acoustic array consistency;

The audio signal is the electric signal which the signal processing unit received from micro-acoustic sensor;

The distribution includes line, plane, arc and cambered surface;

$2^{nd}$, select the mode of the micro-acoustic perception array (1), estimate the direction of interference, and reduce the interference;

The working mode includes monitor mode and tracking mode;

The monitor mode includes the specified direction monitoring mode and the omnidirectional monitoring mode;

Following show the signal processing methods.

$3^{rd}$, find the audio signal and then separate noise signal from audio signal;

$4^{th}$, extract the audio feature information from the audio signal that separated noise signal;

$5^{th}$, extract the location information of sound source from the audio signal which separated noise signal;

$6^{th}$, make a comparison between the audio signal that contains the signal feature information and the sound source location information with the multi object sound source stored in the signal storage unit 3, giving a prompt that found the target sound source when the target have the same feature information in comparison. On the contrary, giving a prompt that no target has found when the comparison is done;

$7^{th}$, locate the sound source according to the sound source location information of the audio signal described in $6^{th}$.

The invention described a kind of micro-acoustic detection analysis equipment, using micro-acoustic perception unit of the graphene membrane to detect sound pressure. The graphene membrane has the minimum thickness, at atomic lever in the thinnest part. The weight of the graphene membrane is lighter than other materials at the same area. All of the covalent bond in the graphene membrane is distribute along the membrane's inner surface, so it has minimum bending stiffness outside the plane. Few damping when graphene membrane's out-of-plane ring bend cause by sound pressure. So, the graphene membrane could detect minimal sound pressure, and the sound intensity proportional to the square of sound pressure, thus, the micro-acoustic detection analysis equipment in this invention has lower detection lower limit than before, could make a solution that have a high sound intensity detection lower limit in the capacitive micro-acoustic detector.

The array audio signal processing method in this invention, implement the $1^{st}$ step before the described processing method to identify the micro-acoustic perception unit with the sound source position, make sure that the synchronization of micro-acoustic perception array's output signal. In the $2^{nd}$ step, make maximum noise restriction through chosen the mode of micro-acoustic perception array. The method in this invention, get the signal that separated the noise through the $3^{rd}$, $4^{th}$, $5^{t}$, and in this audio signal, contains the audio features information and sound source information. In the $6^{th}$ step, make a comparison between the audio signal and the multi sound source objects stored in the signal storage unit, such as audio features information. Locate the sound source according to the sound source location information in $7^{th}$ step. Implement the method that processing array audio signal in this invention not only can make a judgement that whether the detected sound source is the same as sound source information stored in the signal storage unit, but also can locate the detected sound source.

EXAMPLES

For this invention, a micro-acoustic detection analysis equipment and an array audio signal processing method, will make a detail description in the following context using instances and figures.

Case 1: describe this case using FIG. 1, in this case, the micro-acoustic detection analysis equipment includes micro-acoustic perception array 1, signal processing unit 2, signal storage unit 3, and signal analysis unit 4;

The micro-acoustic perception array 1 contains several micro-acoustic sensors;

The micro-acoustic sensor is used to convert the audio signal into electric signal, then transmit the electric signal to the signal processing unit 2;

The micro-acoustic sensor includes micro-acoustic perception unit, the micro-acoustic perception unit includes the graphene membrane, and the graphene membrane used to perceive sound pressure;

The signal processing unit 2 used to process the electric signal, then transmit the electric signal that contained the audio features information and sound source location information to the signal analysis unit 4;

The signal storage unit stored multi sound source objects' audio feature information;

The signal analysis unit 4 used to compare the electric signal that comes from signal processing unit 3 with multi sound source objects' audio feature information, giving a prompt that found the target sound source when the target has the same feature information in comparison. On the contrary, giving a prompt that no target has found when the comparison is done;

The signal analysis unit 4 used as positioning the sound source also, that according to the sound source position information from electric signal of the signal processing unit 2.

Figure 2:
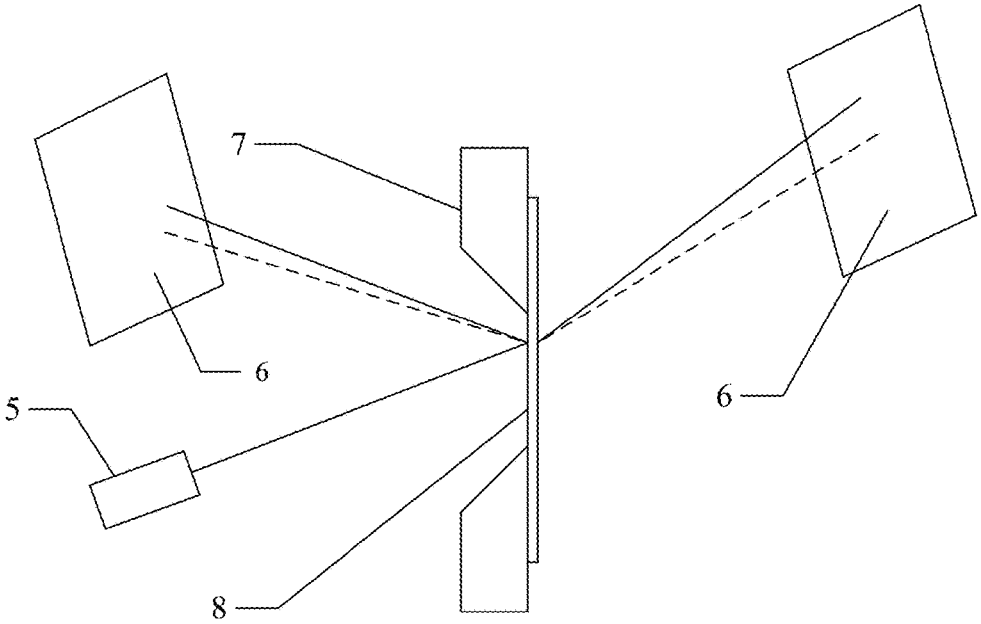
FIG. 2 is the micro-acoustic sensor schematic diagram in case 2.

Case 2: describe this case using FIG. 2, in this case, further qualify the micro-acoustic detection analysis equipment base on case 1, implement a micro-acoustic detection analysis equipment that include laser 5 and photo-sensitive cells 6;

The micro-acoustic perception unit includes substrate 7, which have through-hole. The graphene membrane 8 fixed on one side of substrate 7, covering the through-hole;

When the Laser 5 reaches the surface of the graphene membrane 8 through the through-hole, refraction and reflection are occurred on the surface, then some part of Laser comes to photo surface of the photo-sensitive cells 6;

The photo-sensitive cells 6 is connected with signal processing unit 2.

Laser reaching the surface of the graphene membrane, refraction and reflection on its surface, then incident to the photo surface of photo-sensitive cells, forming facula, solid line in the figure represent the Laser that incident to the photo surface. The laser path will be changed when the graphene membrane shocked by the sound pressure, indicated in the figure by dotted lines, position of the facula on the photo surface will change. The photo-sensitive cell transform the position offset to the electric signal, then transmit the signal processing unit.

Figure 3:
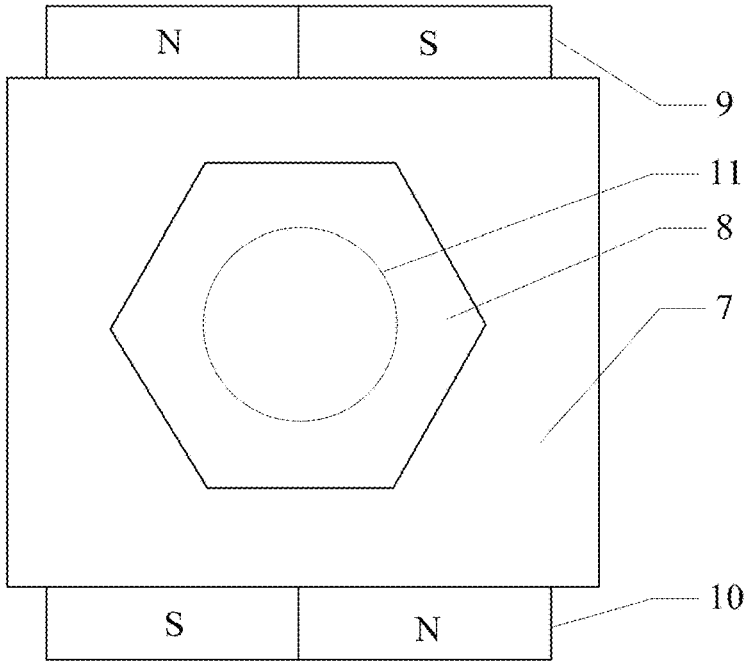
FIG. 3 is the micro-acoustic sensor perception in case 3.
Figure 4:
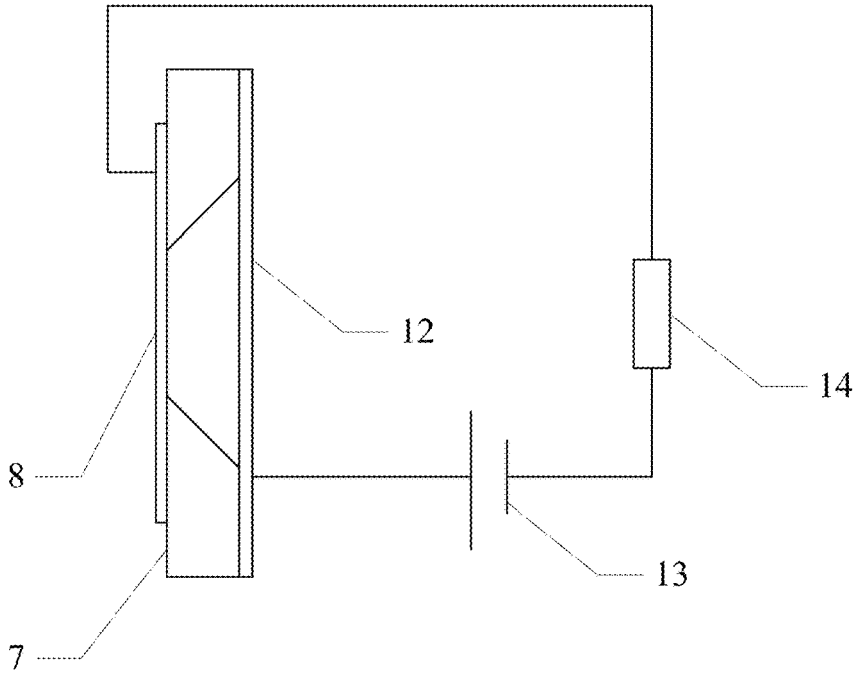
FIG. 4 is the micro-acoustic sensor structure diagram in case 4.

Case 3: describe this case using FIG. 3, in this case, further qualify the micro-acoustic detection analysis equipment base on case 1, implement a micro-acoustic detection analysis equipment that includes the first permanent magnet 9 and the second permanent magnet 10 also;

The micro-acoustic perception unit includes substrate 7, which have through-hole 11. The graphene membrane 8 fixed on one side of substrate 7, covering the through-hole 11;

The first permanent magnet 9 and the second permanent magnet 10 are on the substrate 7, the coupled magnetic field forming between the first permanent magnet 9 and the second permanent magnet 10;

When shocked by sound pressure, the graphene membrane 8 can cut the magnetic induction line, which generate by the coupled magnetic field, when shocked by sound pressure, then generate the electric signal;

The electric signal is received by signal processing unit 2.

As shown in FIG. 3, the first permanent magnet 9 and the second permanent magnet 10 separately fixed on the upper side and lower side, the graphene membrane locate between the first permanent magnet and the second permanent magnet the coupled magnetic field forming between the first permanent magnet 9 and the second permanent magnet 10. The graphene membrane 8 and signal processing unit constitute electrical circuit. The graphene membrane is a kind of good conductor, the graphene membrane 8 can cut the magnetic induction line, which generate by the coupled magnetic field, when shocked by sound pressure, then generate the electric signal;

Case 4: in this case, further qualify the micro-acoustic detection analysis equipment base on case 1, implement a micro-acoustic detection analysis equipment that includes the conductive baffle 12, battery 13 and resistance 14;

The micro-acoustic perception unit includes substrate 7, which have through-hole 11. The graphene membrane 8 and the conductive baffle 12 are fixed on each side of substrate 7, forming a parallel plate capacitor The parallel plate capacitor is to cascade the battery 13, resistance 14 and signal processing unit 2, forming an electric circuit.

In this case, the graphene membrane 8 and the conductive baffle 12 forming a parallel plate capacitor. In addition, this parallel plate capacitor and the battery 13, resistance 14 and signal processing unit 2, forming an electric circuit. In the static mode, no sound pressure on the graphene membrane 8, there is a constant distance between the graphene membrane 8 and the conductive baffle 12, so the capacitance of the parallel plate capacitor. The distance in changed between the graphene membrane 8 and the conductive baffle 12 when the graphene membrane 8 shocked by sound pressure, so the capacitance of the parallel plate capacitor changed. The change of the capacitance results in the change of electric signal.

Figure 5:
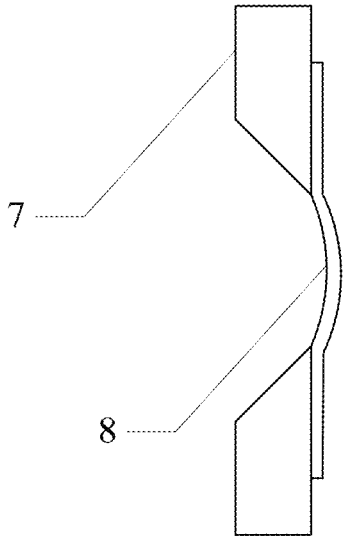
FIG. 5 is the micro-acoustic perception unit's side view in case 5.

Case 5: describe this case using FIG. 5, in this case, further qualify the micro-acoustic detection analysis equipment base on case 2, case 3, or case 4, implement a micro-acoustic detection analysis equipment that there is clearance between the graphene membrane 8 and one side of the through-hole.

As shown in FIG. 5, the graphene membrane 8 is flabby and outstand to the reverse direction of the through-hole in this micro-acoustic perception unit. At the same sound pressure, the amplitude that has a flabby graphene membrane is higher than has a tensioned one.

In this case, further qualify the micro-acoustic detection analysis equipment base on case 1, case 2, case 3, or case 4, implement a micro-acoustic detection analysis equipment that the micro-acoustic perception unit's distribution shows as line, plane, arc or cambered surface.

The line distribution of the micro-acoustic perception units are used to detect the ground sound source of near-field;

The plane distribution of the micro-acoustic perception units are used to detect the sound source in the air;

Micro-acoustic perception units are in an arc profile, and a spatial dimension is increased compared to the linear distribution;

Micro-acoustic perception units are in a cambered surface profile, and a spatial dimension is increased compared to the plane distribution.

Case 7: in this case, further qualify the micro-acoustic detection analysis equipment base on case 6, implement a micro-acoustic detection analysis equipment that replace the graphene membrane (8) with the graphene oxide membrane.

The graphene oxide membrane, and sound pressure perception is slightly worse, the preparation method is simple, low cost compared to the graphene membrane.

Case 8: in this case, further qualify the micro-acoustic detection analysis equipment base on case 1, case 2, case 3, or case 4, implement a kind of micro-acoustic detection analysis equipment that the following procedures must be done before the signal processing method as described.

$1^{st}$, Select a micro-acoustic perception unit distribution mode based on the location of the sound source, and make channels that transmit the audio signal of micro-acoustic array consistency;

The audio signal is the electric signal which the signal processing unit received from micro-acoustic sensor;

The distribution mode includes line, plane, arc and cambered surface;

$2^{nd}$, select the mode of the micro-acoustic perception array (1), estimate the direction of interference, and reduce the interference;

The working mode includes monitor mode and tracking mode;

The monitor mode includes the specified direction monitoring mode and the omnidirectional monitoring mode;

Following show the signal processing methods.

$3^{rd}$, find the audio signal and then separate noise signal from audio signal;

$4^{th}$, extract the audio feature information from the audio signal that separated noise signal;

$5^{th}$, extract the location information of sound source from the audio signal which separated noise signal;

$6^{th}$, make a comparison between the audio signal that contains the signal feature information and the sound source location information with the multi object sound source stored in the signal storage unit 3, giving a prompt that found the target sound source when the target have the same feature information in comparison. On the contrary, giving a prompt that no target has found when the comparison is done;

$7^{th}$, locate the sound source according to the sound source location information of the audio signal described in $6^{th}$.

The audio signal in $3^{rd}$ is noise separable, which means that the noise signal and the audio signal have separation dimension, and the separation dimension is in time domain, spatial domain or frequency domain;

For the sound source has been detected and located, get sound source's the equations of motion according to the prior knowledge or measured information, then extrapolate sound source's location information in the next sample time, pre-forming the location orientation diagram, improve the detection performance for the sound source. At the same time, the motion parameters of the sound source can be deduced according to the source motion equation, and stored in the database as part of the characteristic parameters of the sound source so as to facilitate the recognition and processing of the sound source.

Although specific application cases are applied to describe this invention, but it is should be understood that these are theories and applications that using this invention. So, many modifications and changes can be made to the application cases, provided that the invention does not deviate from the spirit and scope of the invention as defined by the attached claims. It should be understood that different subordinate claims and features described in this article can be combined in different ways than those described in the original claims. It is also understandable that features described in combination with individual application cases can be used in other application cases.

What is claimed is:

1. A device comprising:

multiple micro-acoustic sensors comprising a graphene membrane or graphene oxide membrane configured to deform under sound pressure;

a processor configured to determine audio features from deformation of the graphene membrane or graphene oxide membrane;

wherein the micro-acoustic sensors further comprise a laser and a photo-sensitive cell;

wherein the laser is configured to direct a laser beam toward the graphene membrane or graphene oxide membrane;

wherein the photo-sensitive cell is configured to detect a portion of the laser beam scattered by the graphene membrane or graphene oxide membrane; and wherein the micro-acoustic sensors further comprise a conductive baffle forming a capacitor with the graphene membrane or graphene oxide membrane.

2. The device of claim 1, wherein the micro-acoustic sensors further comprise a first permanent magnet and a second permanent magnet;

wherein the first permanent magnet and the second permanent magnet are configured to generate a magnetic field such that the graphene membrane or graphene oxide membrane cuts magnetic field lines of the magnetic field when the graphene membrane or graphene oxide membrane deforms under the sound pressure.

3. The device of claim 1, wherein the micro-acoustic sensors are positioned along a line or curve, or across a planar or non-planar surface.

4. The device of claim 1, wherein the processor is configured to determine a position of a sound source from deformation of the graphene membrane or graphene oxide membrane.

5. A device comprising multiple micro-acoustic sensors, wherein the micro-acoustic sensors comprise a graphene membrane or graphene oxide membrane configured to deform under sound pressure;

wherein the micro-acoustic sensors further comprise a laser, a processor and a photo-sensitive cell;

wherein the laser is configured to direct a laser beam toward the graphene membrane or graphene oxide membrane;

wherein the photo-sensitive cell is configured to detect a portion of the laser beam scattered by the graphene membrane or graphene oxide membrane; and wherein the processor is configured to detect a movement of position of a facula on the graphene membrane or graphene oxide membrane based on the portion of the laser beam, and determine audio features from deformation of the graphene membrane or grapheme oxide membrane.

6. The device of claim 5, wherein the micro-acoustic sensors further comprise a first permanent magnet and a second permanent magnet;

wherein the first permanent magnet and the second permanent magnet are configured to generate a magnetic field such that the graphene membrane or graphene oxide membrane cuts magnetic field lines of the magnetic field when the graphene membrane or graphene oxide membrane deforms under the sound pressure.

7. The device of claim 5, wherein the micro-acoustic sensors are positioned along a line or curve, or across a planar or non-planar surface.

8. The device of claim 5, wherein the processor is configured to determine a position of a sound source from deformation of the graphene membrane or graphene oxide membrane.

* * * * *